US005275022A

United States Patent [19]

Stoll et al.

[11] Patent Number: 5,275,022

[45] Date of Patent: Jan. 4, 1994

[54] PROCESS FOR THE FULLY-FASHIONED KNITTING OF INTARSIA JACQUARD FABRIC

[75] Inventors: Thomas Stoll, Reutlingen; Wolfgang Rempp, Sonnenbuehl; Uwe Fleiner, Hechingen, all of Fed. Rep. of Germany

[73] Assignee: H. Stoll GmbH & Co., Fed. Rep. of Germany

[21] Appl. No.: 984,115

[22] Filed: Dec. 7, 1992

[30] Foreign Application Priority Data

Dec. 6, 1991 [DE] Fed. Rep. of Germany ..... 4140282

[51] Int. Cl.[5] ..... D04B 7/00

[52] U.S. Cl. ..... 66/67; 66/64; 66/189

[58] Field of Search ..... 66/60R; 66/64; 66/66; 66/67; 66/72; 66/73; 66/76; 66/176; 66/189; 66/196; 66/198; 66/199

[56] References Cited

U.S. PATENT DOCUMENTS

| | | | |
|---|---|---|---|
| 2,330,445 | 9/1943 | Patton | 66/189 X |
| 3,641,788 | 2/1972 | Mori et al. | 66/60 |
| 3,668,901 | 6/1972 | Betts et al. | 66/176 |
| 3,824,810 | 7/1974 | Betts et al. | 66/189 X |

FOREIGN PATENT DOCUMENTS

| | | | |
|---|---|---|---|
| 3322392 | 1/1985 | Fed. Rep. of Germany . | |
| 3838958 | 11/1989 | Fed. Rep. of Germany | 66/64 |
| 0162845 | 8/1985 | Japan | 66/64 |
| 0162846 | 8/1985 | Japan | 66/64 |

OTHER PUBLICATIONS

Knitting Times vol. 40, No. 15 Apr. 12, 1971 pp. 47-55, Knit-to-Shape & Full Fashioned Knitting Principles Offenman Tausch-Martori & Haupt.

The Hosiery Trade Jounal May 1966 pp. 90-96, The LNR Full-Fashioned V-Type Rib Machine, White & Monk.

The LNR Full-Fashioned V-Type Rib Machine, White & Monk.

DE-Z: Melliand Textilberichte Mar. 1989, S.189-192.

*Primary Examiner*—Clifford D. Crowder
*Assistant Examiner*—John J. Calvert
*Attorney, Agent, or Firm*—Larson and Taylor

[57] ABSTRACT

In the process for the fully-fashioned knitting of intarsia jacquard fabric on a two-bed flat knitting machine, intarsia yarns floating on the back of the fully-fashioned fabric are avoided even in intarsia regions of changing width by effecting a yarn-guide adjustment at points of change of direction of the intarsia regions, and the resulting floating intarsia yarns are subsequently bound into the fabric.

5 Claims, 1 Drawing Sheet

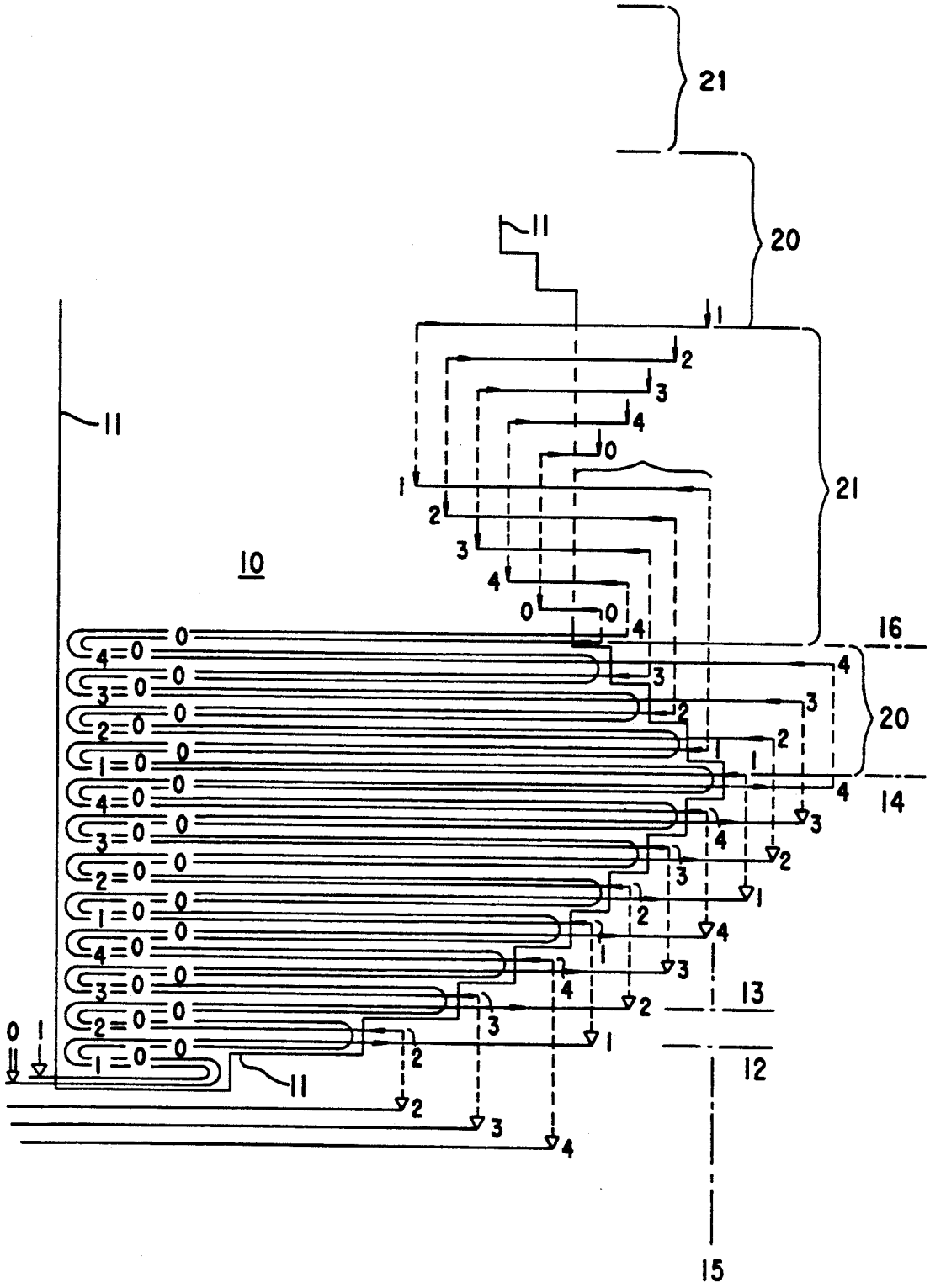
21
20
11
10
16
14
13
12
15

PROCESS FOR THE FULLY-FASHIONED KNITTING OF INTARSIA JACQUARD FABRIC

DESCRIPTION

The invention relates to a process for the fully-fashioned knitting of intarsia jacquard fabric on a two-bed flat knitting machine.

In the fully-fashioned knitting of intarsia jacquard fabric, it also happens that the width of intarsia regions changes and a narrowing of these regions becomes necessary. The problems with intarsia yarns exposed on the back of the fabric are aggravated by this.

The object on which the invention is based is to provide a process by means of which exposed intarsia yarns are avoided even in narrowing regions of an intarsia jacquard fabric.

This object is achieved according to the invention by means of forming adjacent rows of stitches in an intarsia region in a fabric forming direction of either increasing or decreasing row lengths by means of alternating yarn guides equipped with intarsia yarns; repositioning said yarn guides to adjust the length of the rows; repeating said steps of forming and repositioning until a point at which the fabric forming direction changes; readjusting said yarn guides to form adjacent rows of stitches in the fabric forming direction at said point of change; binding floating intarsia yarns formed during said step of readjusting; and repeating said steps of forming, repositioning, repeating, readjusting and binding until knitting of said fabric is completed. As a result of the movement of the yarn guides at the points of change of direction and the readjustment of the yarn guides after the binding of the intarsia yarns floating during the movement into the fabric, intarsia yarns acquire a direction of inclination which makes it possible to knit over and beyond them. The binding in of the floating intarsia yarns can be carried out by the transfer of stitches over the intarsia yarns. However, the binding in of the floating intarsia yarns can also be carried out by the formation of a tuck-net row over the floating intarsia yarns, for which purpose yarn guides which have not been previously moved in are used. The subsequent readjustment by means of some of the yarn guides equipped with intarsia yarns can take place, as a rule, in the direction opposite to the moving-in direction.

The formation of a tuck-net row over the floating intarsia yarns can also be carried out by means of an additional yarn guide which is expediently equipped with a basic yarn. Also, in the process, the intarsia yarns can advantageously each be worked together with a basic yarn. The process steps listed above guarantee an intarsia jacquard fabric in which exposed yarns appear nowhere on the back of the fabric.

An exemplary embodiment of the process is explained in more detail below by means of the accompanying drawing.

The drawing shows diagrammatically the adjustment of four yarn guides 1–4 equipped with intarsia yarns and of a yarn guide 0 equipped with a basic yarn during the knitting of an intarsia region of changing width which, here, is knitted according to a continuously recurring repeat. The limitation of the intarsia region 10 is indicated by a boundary line 11. The fully-fashioned knitting begins at bottom left with the yarn guide 0 equipped with a basic yarn and with the intarsia-yarn guide 1. The yarn guides 2, 3 and 4, likewise equipped with intarsia yarns, are advanced to a favourable initial position in the fabric-forming direction. After the formation of three rows of fabric, the yarn guide 1 is moved forwards at the fabric height 12 into a new initial position, whilst at the beginning of the fourth row of fabric the yarn guide 2, together with the basic-yarn guide 0, is used over two rows of fabric up to the fabric height 13. The yarn guide 2 is then also moved forwards into a new initial position, and the next row of fabric is knitted with the intarsia-yarn guide 3 together with the basic-yarn guide 0. Subsequently, the intarsia-yarn guide 4 is also used for the first time in the same manner evident from the drawing; thereafter, the intarsia-yarn guides 1 to 4 are also used a second time. A maximum length 15 of intarsia region is then reached at the fabric height 14, and a narrowing of the length of intarsia region is to take place up to the fabric height 16.

At the fabric height 14, during the return of the carriage of the two-bed flat knitting machine employed here, the intarsia-yarn guides 1 to 3 are moved into the fabric region to a position to be resumed later, and subsequently the intarsia yarns, floating as a result of this, are bound onto or into the hitherto formed fully-fashioned fabric by means of the intarsia-yarn guide 4 and the basic-yarn guide 0 which form a tuck-net row by means of needles of the two needle beds of the flat knitting machine. Subsequently, the moved-in intarsia-yarn guides 1 to 3 and also the intarsia-yarn guide 4 are readjusted, here moved back, into an initial position favourable for the further knitting run. The region of the intarsia jacquard fabric 10 designated by 20 and extending to the fabric height 16 is then produced with the alternating use of the intarsia-yarn guides 1 to 4, each together with the basic-yarn guide 0 again. Thereafter, a reduction of the intarsia region is carried out once more, as at the outset, in a region 21. This is then followed once again according to the repeat by a fabric region 21.

In the drawing, the adjustment of the yarn guides into different positions is indicated diagrammatically in the fabric region 21. The said tuck-net row and the fabric pattern of the intarsia region 10 are not shown. The tuck-net row can be formed in the conventional manner, if desired with larger distances between the needles of the two needle beds used. Also, different stitch and/or tuck-loop sequences can be provided for the intarsia yarn of the yarn guide 4 and the basic yarn of the yarn guide 0. Stitches and loops can occur in the intarsia fabric, and the needles of the needle beds are selected by the jacquard method by means of a patterning device.

We claim:

1. A method for the fully-fashioned knitting of intarsia jacquard fabric on a two-bed flat knitted machine, comprising the steps of:

forming adjacent rows of stitches in an intarsia region in a fabric forming direction of either increasing or decreasing row lengths by means of alternating yarn guides equipped with intarsia yarns;

repositioning said yarn guides to adjust the length of the rows;

repeating said steps of forming and repositioning until a point at which the fabric forming direction changes;

readjusting said yarn guides to form adjacent rows of stitches in the fabric forming direction at said point of change;

binding floating intarsia yarns formed during said step of readjusting; and repeating said steps of forming, repositioning, repeating, readjusting and binding until knitting of said fabric is completed.

2. The method according to claim 1, wherein said step of binding comprises transferring stitches from a first needle over the floating intarsia yarns to a second needle.

3. The method according to claim 1, wherein said step of binding comprising catching the floating intarsia yarns during the formation of stitches.

4. The method according to claim 3, wherein at least one of the yarn guides is equipped with yarns forming the base fabric.

5. The method according to claim 1, wherein the intarsia yarns and yarns forming the base fabric are knit together.

* * * * *